US005817961A

United States Patent [19]

Beck

[11] Patent Number: 5,817,961

[45] Date of Patent: Oct. 6, 1998

[54] STRINGED INSTRUMENT SUPPORTING DEVICE

[76] Inventor: Richard Beck, 1338 Gable Dr., Warsaw, Ind. 46580

[21] Appl. No.: 843,894

[22] Filed: Apr. 17, 1997

[51] Int. Cl.[6] ..... G10D 3/00

[52] U.S. Cl. ..... 84/327

[58] Field of Search ..... 84/327

[56] References Cited

U.S. PATENT DOCUMENTS

| | | | |
|---|---|---|---|
| D. 337,345 | 7/1993 | Gracie | 84/327 |
| 3,037,416 | 6/1962 | Cunningham | 84/327 |
| 5,000,071 | 3/1991 | Thomas | 84/327 |
| 5,069,103 | 12/1991 | Healy | 84/327 |
| 5,493,941 | 2/1996 | Verge | 84/327 |

*Primary Examiner*—Michael L. Gellner
*Assistant Examiner*—Daniel Chapik
*Attorney, Agent, or Firm*—Baker & Daniels

[57] ABSTRACT

A device for supporting a stringed musical instrument in a playing position including a vertical brace with attachment straps at its upper and lower ends to attach the device to the musician's torso and leg. A bracket is connected to the vertical brace and extends forwardly in supporting an instrument cradle which holds the body of the instrument.

14 Claims, 5 Drawing Sheets

STRINGED INSTRUMENT SUPPORTING DEVICE

The present invention relates to a device, attachable to the body of a musician, for supporting a stringed musical instrument in a playing position.

BACKGROUND OF THE INVENTION

Stringed musical instruments, such as electric guitars, are often relatively heavy and difficult to simultaneously hold and play for extended periods of time. Some electrical stringed instruments are so heavy, it is difficult for a musician in a standing position to pluck and finger the instrument without the aid of some device to support the weight of the instrument.

Conventional supporting devices primarily consist of straps, which attach to the body and neck of the instrument and loop over the musician's shoulder, and stationary stands which are placed on the floor and adjusted to hold the instrument at an appropriate height for playing. These devices are inadequate for various reasons. Although stationary stands eliminate the physical strain of supporting the weight of the instrument during a performance, the musician is forced to remain in one position behind the stand while playing the instrument. Consequently, the theatric movement of the performer during the concert is severely limited. Shoulder straps permit the musician to move freely while playing the instrument, but the full weight of the instrument is carried on one of the musician's shoulders. The weight of the instrument supported in such a manner can cause neck, shoulder and back pain, particularly in older musicians or musicians with back problems and other physical infirmities. Of course, the discomfort resulting from shoulder strap use is of particular concern to musicians who perform frequently and/or for extended periods of time.

SUMMARY OF THE INVENTION

The present invention provides a device which attaches to a musician's torso for supporting a stringed musical instrument, such as a guitar or a bass, in front of the musician in a playing position. The device includes a vertical brace with a waist strap at its upper end and a thigh strap at its lower end. A pair of support arms extend forwardly from the vertical brace to form a cradle which holds the body of the instrument in a playing position. When the device is attached in place, the weight of the instrument is carried by the musician's waist and leg. As such, the neck, shoulder and back discomfort associated with shoulder straps is virtually eliminated. Furthermore, the musician is free to move about while playing the instrument. Additionally, the stable positioning of the instrument relative to the musician's torso provided by the present invention enhances the musician's ability to manipulate the strings of the instrument.

Accordingly, it is an object of the present invention to provide a stringed instrument supporting device which attaches to the body of a musician and supports a stringed instrument in a playing position.

Another object of the present invention is to provide a stringed instrument supporting device which permits the musician to walk while playing the instrument.

Another object of the present invention is to provide a stringed instrument supporting device which should not cause neck, shoulder or back pain, even after supporting an instrument for an extended period of time.

Yet another object of the invention is to provide a stringed instrument supporting device which transfers the weight of the instrument to the musician's waist and leg while positioning the instrument in a playing position.

Still another object of the present invention is to provide a stringed instrument supporting device which enhances the musician's ability to accurately manipulate the strings of the instrument.

BRIEF DESCRIPTION OF THE DRAWINGS

The above-mentioned and other objects and advantages of this invention, and the manner of obtaining them, will become more apparent and the invention will be better understood by reference to the following description of embodiments of the invention taken in conjunction with the accompanying drawings wherein.

Figure 1:
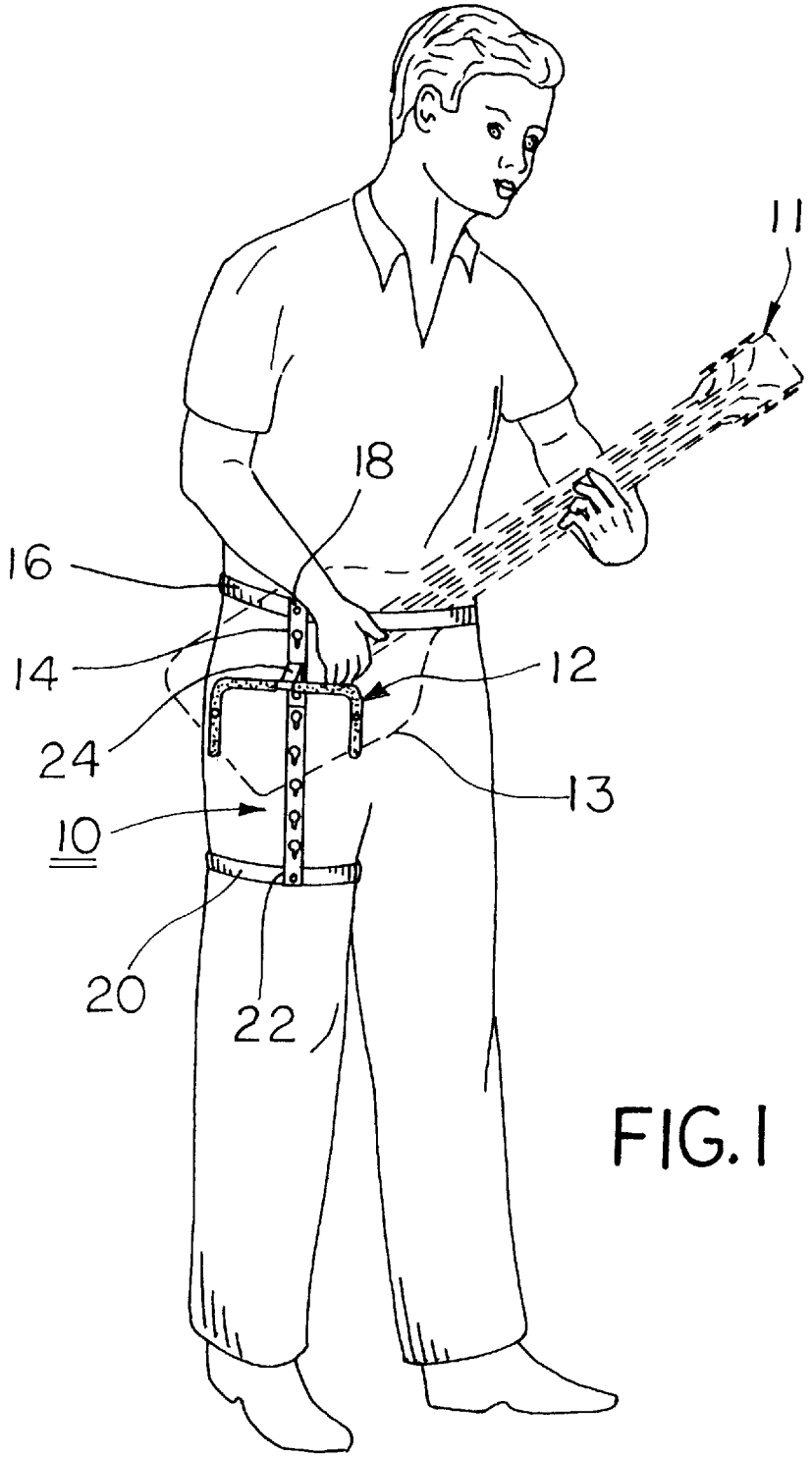
FIG. 1 is perspective view of a stringed instrument supporting device according to the present invention shown worn by a musician and supporting a stringed instrument.

Corresponding reference characters indicate corresponding parts throughout the several views. Although the drawings represent embodiments of the present invention, the drawings are not necessarily to scale and certain features may be exaggerated to better illustrate and explain the present invention.

DETAILED DESCRIPTION OF THE INVENTION

The embodiments disclosed in the detailed description below are not intended to be exhaustive or to limit the invention to the precise forms disclosed. Rather, the embodiments selected for the description are disclosed so that others skilled in the art may utilize their teachings.

Figure 2:
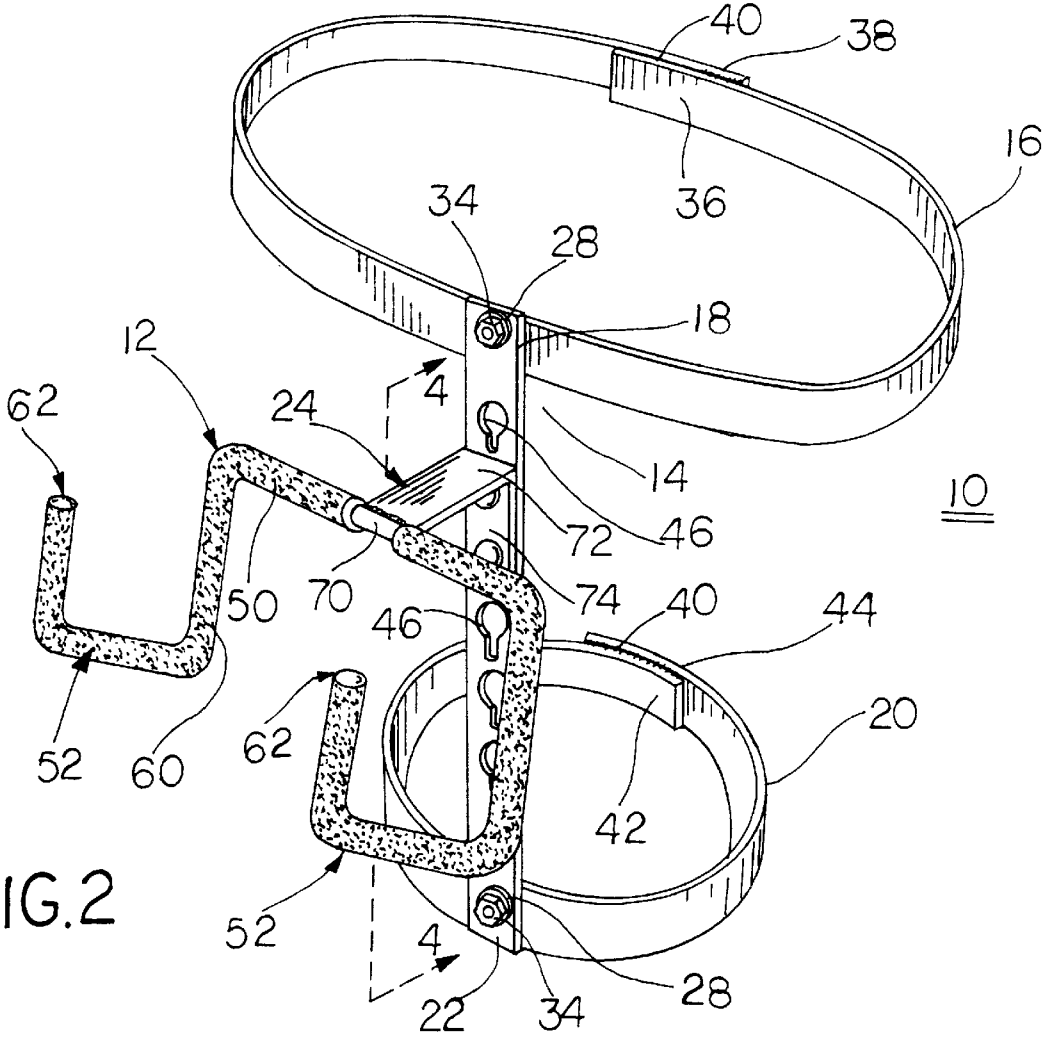
FIG. 2 is a perspective view of the device shown in FIG. 1.
Figure 3:
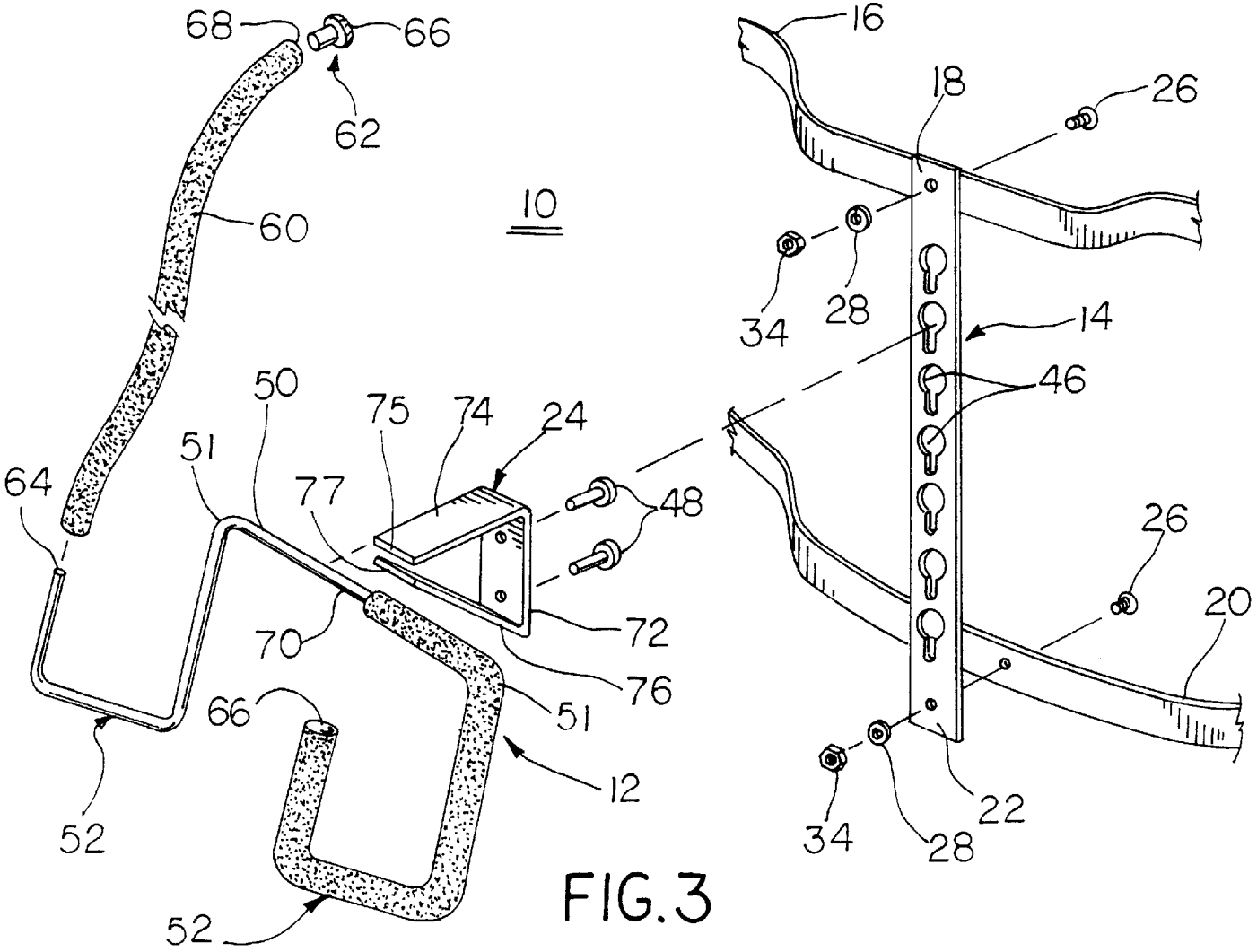
FIG. 3 is a partially fragmented, exploded perspective view of the device shown in FIG. 2.

FIG. 1 shows the stringed instrument supporting device 10 of the present invention worn by a musician and supporting a stringed instrument 11 (shown for illustrative purposes in broken lines). Device 10 includes an instrument cradle 12 for holding the body 13 of the instrument, a vertical brace 14, preferably rigid, a flexible waist strap 16, and a flexible leg strap 20. Waist strap 16 is attached to the upper end 18, and leg strap 20 is attached to the lower end 22 of brace 14. A bracket 24 connects cradle 12 to the brace. As best shown in FIGS. 2 and 3, waist strap 16 and leg strap 20 can be attached to brace 14 in any conventional manner such as by screws 26, lock washers 28, and nuts 34. One end segment 36 of waist strap 16 is adjustably attached to the other end segment 38 using "VELCRO" 40 or some other suitable attachment method. End segment 42 of leg strap 20 is similarly attached to end segment 44.

In an exemplary embodiment, instrument cradle 12 is a single piece of tubular material bent or formed to define a horizontal crossbar 50 with J-shaped support arms 52 depending from each end 51. Instrument cradle 12 could be formed into a variety of shapes to support the instrument's body.

In one embodiment, a compliant sleeve 60 is slid over each arm 52 to prevent damage to instrument body 13. Each sleeve 60 also extends over substantially one half of crossbar 50 and is retained onto its support arm by an end cap 62. End caps 62 are press fitted into the open ends 64 of the arms. The heads 66 of end caps 62 overlap the ends 68 of sleeves 60, thereby preventing the sleeves from slipping off of support arms 52. In an alternate embodiment, arms 52 are simply coated with a pliable, polycoat material using procedures well known to those skilled in the art.

Figure 4:
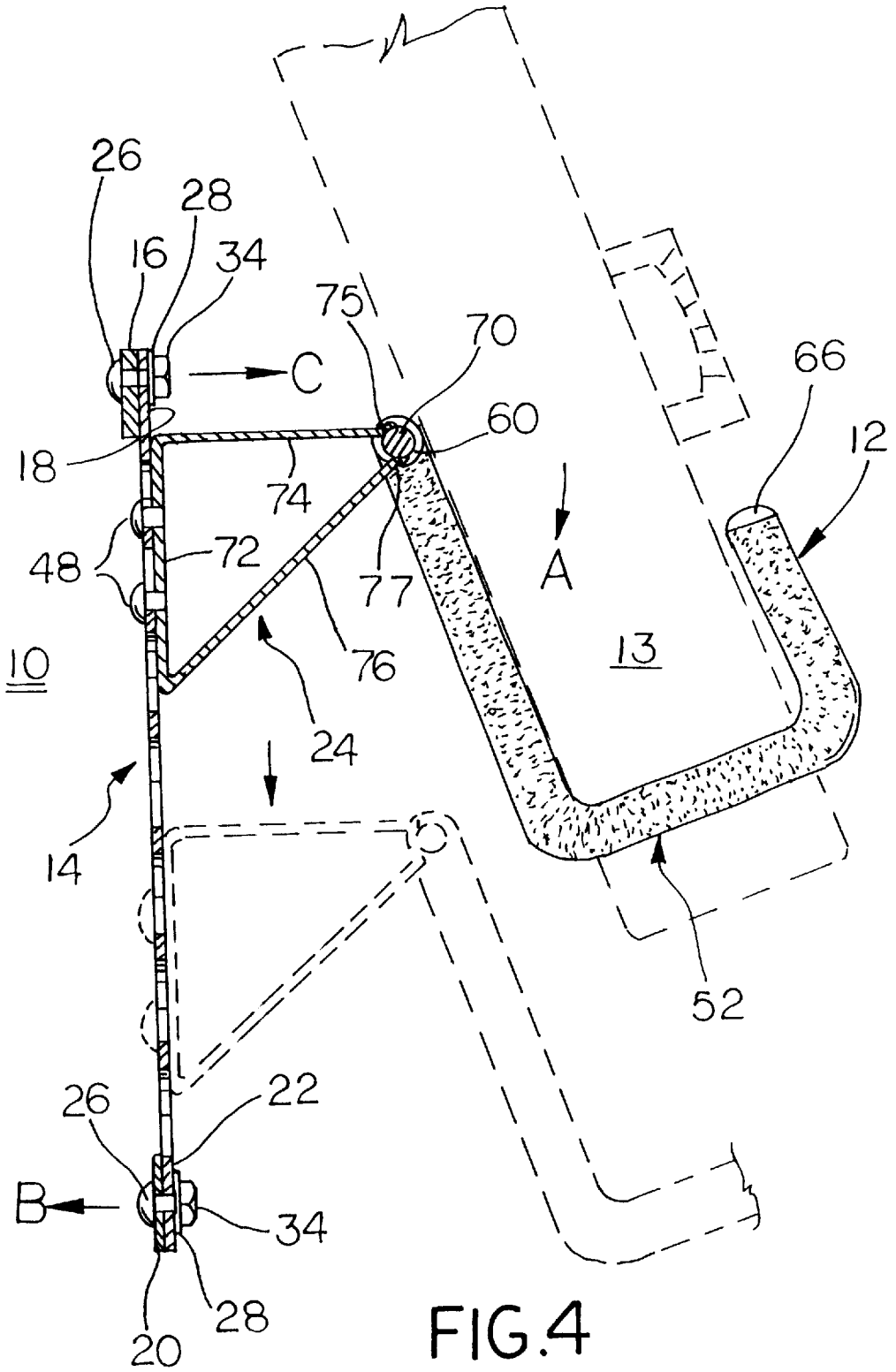
FIG. 4 is a cross sectional view taken substantially along line 4—4 of FIG. 2.

A bracket 24 connects crossbar 50 to brace 14. Brace 14 also includes a plurality of key-shaped holes 46 aligned along its length for interlocking with lugs 48 of bracket 24. Bracket 24 includes a beam 74 and an angled support 76, each welded or otherwise rigidly attached to center portion 70 of crossbar 50 with instrument cradle 12 being supported at a tilted orientation. Lugs 48 are attached to vertical member 72 of bracket 24 in a conventional manner, such as by welding, so as to protrude from the vertical member a distance corresponding to the thickness of brace 14. Lugs 48 are spaced for alignment with pairs of key-shaped holes 46 on brace 14. Bracket 24 is connected to brace 14 by inserting lugs 48 through a selected pair of key-shaped holes 46 and shifting bracket 24 downwardly so that lugs 48 interlock with the slotted portions of holes 46. Accordingly, bracket 24 and attached cradle 12 are vertically adjustable relative to brace 14 as shown in broken lines in FIG. 4.

Mode of Operation

In operation, supporting device 10 is attached to the musician by strapping waist strap 16 around the musician's mid-section and securing the ends 36,38 to one another. Leg strap 20 is then attached to the musician's thigh in a like manner by connecting ends 42,44 to one another. Once device 10 is attached to the musician, body 13 of instrument 11 is positioned onto instrument cradle 12 so that the neck of the instrument is properly positioned for fingering as shown in FIG. 1. Preferably, the lower edge of body 13 sits within support arms 52, and the back of body 13 rests against horizontal crossbar 50. Support arms 52 overly the front surface of the instrument body. Typically, a portion of the instrument body projects below and between support arms 52. Although by positioning body 13 of instrument 11, device 10 also positions the instrument neck, a conventional shoulder strap may also optionally be attached to the instrument in a standard manner further to retain the neck of the instrument in a relatively fixed position.

Instrument 11 is urged gravitationally downwardly against instrument cradle 12 (as shown by arrow "A" of FIG. 4) which urges brace 14 downwardly relative to the musician, thereby pulling on waist strap 16 and leg strap 20. Also, since cradle 12 is cantilevered outwardly relative to brace 14, the downward force of instrument 11 creates a moment about the attachment between bracket 24 and brace 14. Accordingly, an inward force is generated at lower end 22 of brace 14 and an outward force is created at upper end 18 (as shown by arrows "B" and "C" of FIG. 4, respectively). As such, device 10 supports the weight of instrument 11 by transferring that weight to the torso and thigh of the musician. As a result, the shoulder, neck and back fatigue and pain typically experienced with shoulder strap use is eliminated. Furthermore, since device 10 retains the instrument in a substantially fixed position relative to the musician's leg, more accurate picking is possible. Also, the musician is free to walk during the performance.

Figure 5:
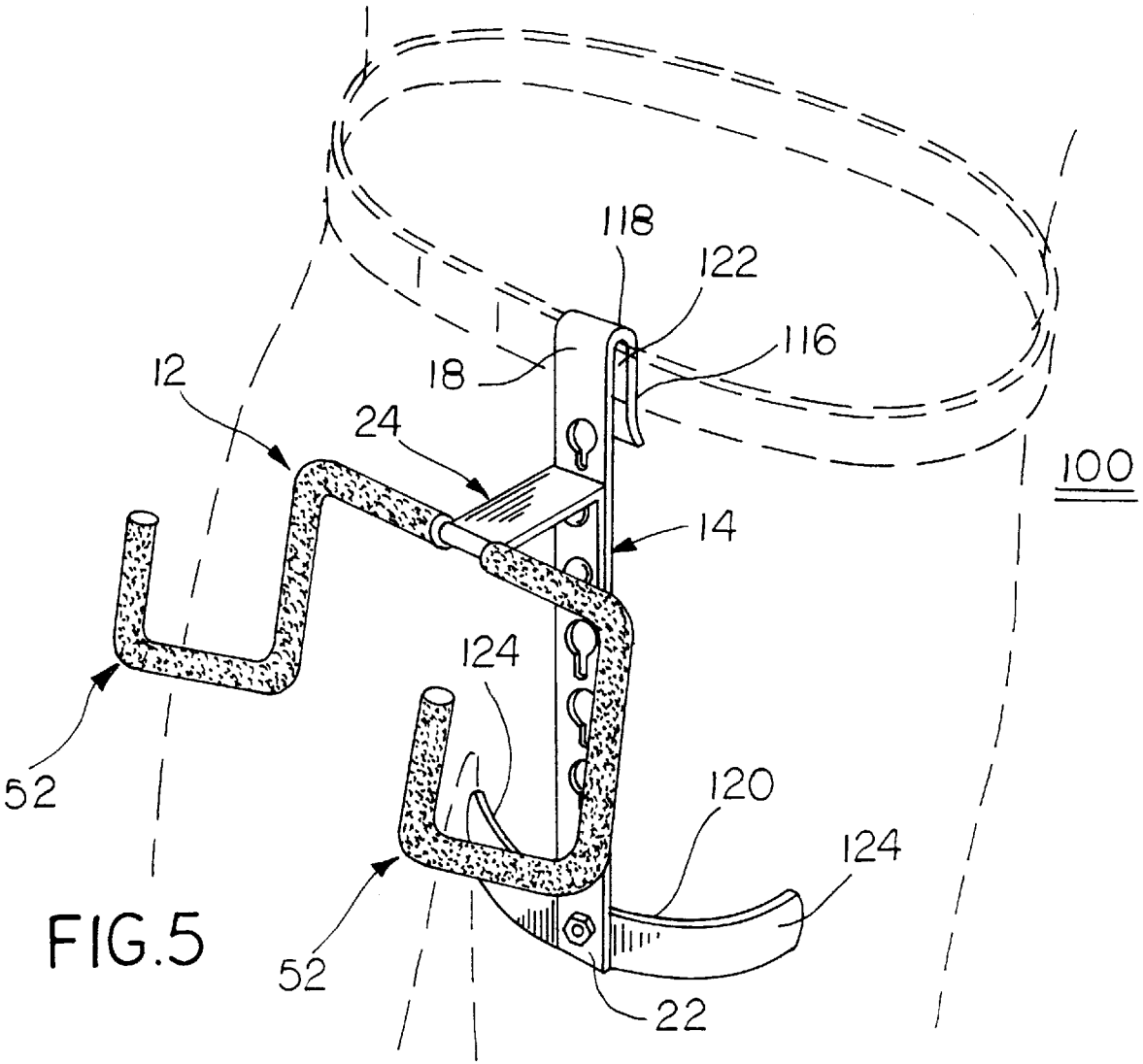
FIG. 5 is a perspective view of another embodiment of a stringed instrument supporting device according to the present invention.

FIG. 5 shows another embodiment of the present invention wherein waist strap 16 has been replaced with a hook 116 and leg strap 20 has been replaced with an alignment member 120. Hook 116 extends from a bend 118 at upper end 18 of brace 14 to overlie the back of the vertical brace, thereby defining a gap 122. Device 100 is attached to a musician by simply hooking hook 116 over the musician's belt or waistband as shown in FIG. 5. Obviously, hook 116 could also be hooked over other objects, such as wall mounted mating hooks for displaying the instrument when not in use.

Alignment member 120 is curved to correspond roughly to the contour of a thigh. When device 100 is attached to the musician, the inward force at lower end 22 of brace 14 created by the weight of the instrument (as described previously) urges alignment member 120 into engagement with the musician's thigh. Alignment member 120 curves sufficiently around the musician's thigh so that ends 124 prevent side-to-side swinging of brace 14, even when the playing musician walks.

While this invention has been described as having exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for supporting a stringed instrument in a playing position from the front of a person having thighs, said instrument including a body having opposite sides and a lower edge connecting the sides, said device comprising:

a vertical brace having an upper end and a lower end, said upper end having a connector securing said brace to a waist strap for extending around the waist of the person to attach said vertical brace to the person, said brace extending downwardly from said connector to a lower end, a thigh engaging member to support said vertical brace against the thigh of said person; and support means connected to said vertical brace between said connector and said thigh engaging member for holding the instrument in the playing position, said support means including a cradle adapted to receive the body of the instrument and including members extending along both sides of said body and across said lower edge thereof to thereby support said instrument in a playing position without attachments mounted on the instrument, said cradle projecting outwardly from said vertical brace so that the weight of the instrument urges said lower end of said vertical brace against the thigh of the person.

2. A device as claimed in claim 1 wherein said thigh engaging member is a strap adapted to fasten around the thigh of said person.

3. A device as claimed in claim 1 wherein said waist strap is a standard garment belt and said connector of said vertical brace is an inverted J-hook, said J-hook being adapted to hook over said standard garment belt thereby suspending said device from the belt.

4. A device as claimed in claim 1 wherein said thigh engaging member is a substantially C-shaped alignment member partially encircling one of said thighs of said person to maintain said vertical brace in a substantially fixed position relative to said leg.

5. A device as claimed in claim 1, said support means further including a bracket rigidly attached to said cradle and supporting said instrument displaced from said support, said bracket including means for connecting said bracket to said vertical brace.

6. A device as claimed in claim 5 wherein said bracket includes a vertical member connected to said vertical brace, a beam extending between said vertical member and said cradle, and an angled support extending between said vertical member and said beam.

7. A device as claimed in claim 5, said connecting means including adjustment lugs for interlocking connection to said vertical brace.

8. A device as claimed in claim 7, said vertical brace having a plurality of mating openings for receiving said adjustment lugs, said adjustment lugs seating in selected ones of said mating openings thereby permitting selective vertical positioning of said support means relative to said vertical brace.

9. A device as claimed in claim 1, said cradle including a pair of spaced apart, tubular arms, each of said arms forming a J-shaped hook for supporting the instrument.

10. A device as claimed in claim 9, said cradle further including at least one compliant sleeve substantially encasing said arms for preventing damage to the body of the instrument as the instrument is supported in the playing position.

11. A device as claimed in claim 9, said cradle further including a crossbar connected to said vertical brace, said crossbar extending in perpendicular relationship to said vertical brace and including two ends substantially equally spaced from said vertical brace, each of said arms extending downwardly relative to said vertical brace from one of said crossbar ends.

12. A supporting device for cradling the body of a stringed instrument in front of a person so that the instrument is positioned for playing, said instrument including a body having opposite sides and a lower edge connecting the sides, said device comprising:

a waist strap;

a vertical brace suspended from said waist strap extending downwardly and carrying a support brace to engage the thigh of said person;

a cradle connected to said vertical brace between the waist strap and the support brace to hold said instrument body in a playing position relative to the front of said person, said cradle including a pair of arms projecting outwardly from said vertical brace, said arms extending along both sides of said body and across said lower edge thereof to thereby support said instrument in a playing position without attachments mounted on the instrument, and being adapted to hold said instrument body with the weight of the instrument being transferred through said cradle to said vertical brace wherein part of the weight is carried by said waist strap and the remainder of the weight is supported by said support brace.

13. A supporting device is claimed in claim 12, said cradle further including a bracket and supporting said instrument displaced from said support, said bracket carrying means for interlocking said bracket to said vertical brace.

14. A supporting device as claimed in claim 13, said interlocking means including a pair of spaced apart lugs extending from said bracket, said vertical brace defining a plurality of openings along its length, said lugs interlocking with a selected pair of said openings with said cradle thereby being adjustably positioned relative to said vertical brace.

* * * * *